US011459759B1

(12) United States Patent
Tolera et al.

(10) Patent No.: US 11,459,759 B1
(45) Date of Patent: Oct. 4, 2022

(54) ROOF SHINGLES HAVING PERFORATIONS

(71) Applicants: Ameyu Tolera, Miami, FL (US); Arindam Gan Chowdhury, Miami, FL (US); Ioannis Zisis, Miami, FL (US)

(72) Inventors: Ameyu Tolera, Miami, FL (US); Arindam Gan Chowdhury, Miami, FL (US); Ioannis Zisis, Miami, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 0 days.

(21) Appl. No.: 17/663,708

(22) Filed: May 17, 2022

(51) Int. Cl.
*E04D 1/30* (2006.01)
*E04D 1/00* (2006.01)
*E04D 1/26* (2006.01)

(52) U.S. Cl.
CPC ..... *E04D 1/30* (2013.01); *E04D 1/26* (2013.01); *E04D 1/29* (2019.08); *E04D 2001/308* (2013.01)

(58) Field of Classification Search
CPC .... E04D 1/30; E04D 1/26; E04D 1/29; E04D 2001/308; E04D 1/2907; E04D 1/2914; E04D 1/2916; E04D 1/2918; E04D 1/2921; E04D 1/2928; E04D 1/2935; E04D 1/2942; E04D 1/2949; E04D 1/2956; E04D 1/2963; E04D 1/2984; E04D 5/12
See application file for complete search history.

(56) References Cited

U.S. PATENT DOCUMENTS

| | | | | |
|---|---|---|---|---|
| 2,096,784 | A * | 10/1937 | Candler | E04D 5/12 52/553 |
| 2,122,747 | A * | 7/1938 | Kirschbraun | E04D 5/12 52/553 |
| 4,023,321 | A * | 5/1977 | Smith | E04D 1/29 52/750 |
| 4,726,985 | A * | 2/1988 | Fay | B32B 15/12 428/920 |
| 5,291,712 | A * | 3/1994 | Curran | E04D 1/26 52/302.1 |
| 6,360,497 | B1 * | 3/2002 | Nakazima | H02S 40/34 52/173.3 |
| 8,468,754 | B2 * | 6/2013 | Railkar | E04D 1/26 52/173.3 |
| 8,707,643 | B1 * | 4/2014 | Kalkanoglu | H02S 40/425 52/173.3 |
| 10,574,178 | B2 * | 2/2020 | Lopez | E04D 1/12 |
| 2003/0150170 | A1 * | 8/2003 | Weber | E04D 13/00 52/518 |

OTHER PUBLICATIONS

J. A. Peterka et al., Wind Uplift Model for Asphalt Shingles, Journal of Architectural Engineering, Dec. 1997, 3 (4): 147-155.

* cited by examiner

*Primary Examiner* — Adriana Figueroa
(74) *Attorney, Agent, or Firm* — Saliwanchik, Lloyd & Eisenschenk

(57) ABSTRACT

Roof shingles are provided, as well as methods of fabricating and using the shingles and roofs comprising the shingles. A shingle can include a plurality of perforations in the protruding part thereof to significantly reduce the pressure in the leading edge, the remainder of the protruding part, and/or in the area behind the sealing strip of the shingle. The perforations can be disposed in the protruding part of the shingle down from the sealing strip. Any water entering the perforations can therefore be blocked by the sealing strips and will flow down the roof slope.

20 Claims, 8 Drawing Sheets

$p_3 \geq p_2$

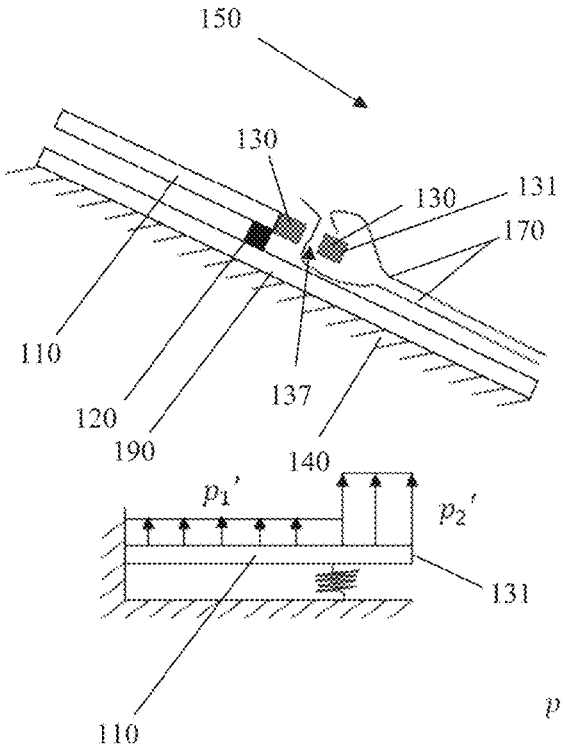
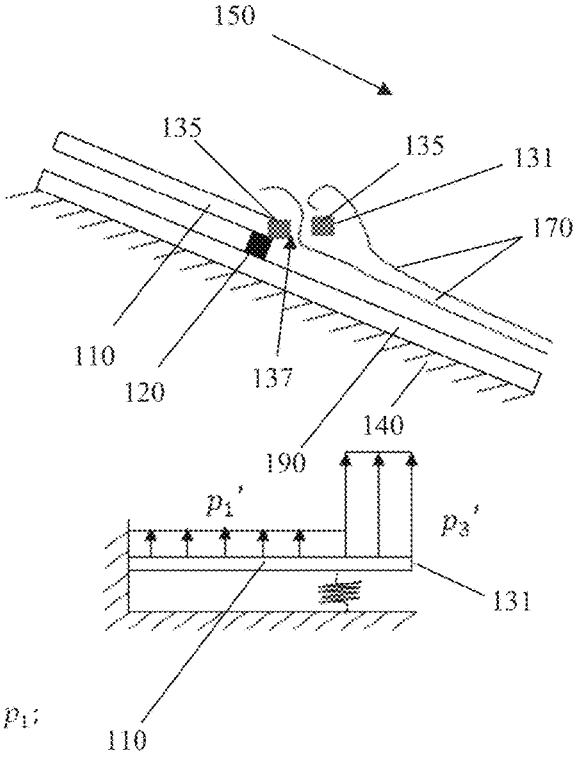
$p_1' \leq p_1;$
$p_2' < p_2;$
$p_3' < p_3$
FIG. 3A
FIG. 3B

Velocity contour (without perforation)

Velocity contour (with added perforation) – at location of holes

Velocity contour (with added perforation) – at location of no holes

Without perforations

With 10% perforation

*Pressure contour on top surface of shingles*

Without perforations

With 10% perforation

*Pressure contour on bottom surface of shingles*

*Velocity contour (with no perforation and lifted 25°)*

*Velocity contour (with added perforation and lifted 25°) – at location of holes*

*Velocity contour (with added perforation and lifted 25°) – at location of no holes*

ROOF SHINGLES HAVING PERFORATIONS

GOVERNMENT SUPPORT

This invention was made with government support under 1841503 awarded by the National Science Foundation. The government has certain rights in the invention.

BACKGROUND

Wind loads on asphalt roofing shingles are dictated by the local element flow field among other parameters such as the building geometry and upstream terrain and flow conditions. Asphalt shingles experience high wind loads due to wind flows that separate from their leading edges to cause suction on the top surface while simultaneously causing positive pressure on the lower surface (see also, e.g., Peterka et al., Wind Uplift Model for Asphalt Shingles, Journal of Architectural Engineering, 1997). This local phenomenon results in a loading mechanism that seeks to peel off the shingles by essentially grabbing their protruding section and rolling it over. Once this lift-off is initiated, the load on the shingle significantly increases due to a change in the local aerodynamics. This notion forms the basis for the current standardized tests for the wind resistance of asphalt shingles, e.g., the American Society for Testing and Materials (ASTM) Standard Test Method for Wind Resistance of Asphalt Shingles (Uplift Force/Uplift Resistance Method), designated as D7158/D7158M (ASTM International, 2020b).

BRIEF SUMMARY

Embodiments of the subject invention provide novel and advantageous shingles, as well as methods of fabricating and using the shingles and roofs comprising the shingles. A shingle can include a plurality of perforations in the protruding part thereof to significantly reduce the pressure in the leading edge, the remainder of the protruding part (i.e., the part of the shingle that protrudes beyond the sealing strip), and even in the area behind the sealing strip of the shingle. The perforations can be disposed in the protruding part of the shingle down (i.e., in the direction water flows downward on the roof) from the sealing strip (i.e., between the leading edge and the sealing strip). Thus, any water entering the perforations can be blocked by the sealing strips and can flow down the roof slope. The shingle can be, for example, an asphalt shingle, though embodiments are not limited thereto.

In an embodiment, a roof shingle can comprise: an upper surface and a lower surface opposite from the upper surface; a sealing strip disposed on the lower surface and configured to adhere the roof shingle to another roof shingle or to a main surface of a roof; a protruding part protruding away from the sealing strip in a direction parallel to the upper surface of the roof shingle, the protruding part comprising a leading edge connecting the upper surface and the lower surface and configured to face in a downward slope direction of a roof on which the roof shingle is disposed; and a plurality of perforations disposed on the protruding part and penetrating through the roof shingle from the upper surface of the roof shingle to the lower surface of the roof shingle. The plurality of perforations can be disposed between the leading edge and the sealing strip. Each perforation of the plurality of perforations can have, for example, a circular cross-section (taken in a plane parallel to the lower surface of the roof shingle), though embodiments are not limited thereto. The roof shingle can have a perforation percentage (an area of an upper surface of the protruding part taken up by the plurality of perforations divided by a total area of the upper surface of the protruding part) of, for example, at least 3%, at least 5%, at least 10%, or about 10%. A shortest distance from each perforation of the plurality of perforations to the leading edge can be the same as that for all other perforations of the plurality of perforations (that is, all perforations can be spaced apart from the leading edge by the same amount, as shown in FIG. 2B). The plurality of perforations can be disposed in an equidistant manner across the roof shingle in a lateral direction perpendicular to the downward slope direction and parallel to the lower surface of the roof shingle. The roof shingle can be, for example, an asphalt roof shingle.

In another embodiment, a roof shingle system can comprise a main roof surface and a plurality of roof shingles disposed on the main roof surface. Each roof shingle of the plurality of roof shingles can be a roof shingle as disclosed herein.

BRIEF DESCRIPTION OF DRAWINGS

FIG. 3A shows a cross-sectional view of wind against a shingle with perforations, according to an embodiment of the subject invention.

FIG. 3B shows a cross-sectional view of wind against a shingle, with a leading edge starting to lift-off, where the shingle has perforations, according to an embodiment of the subject invention.

DETAILED DESCRIPTION

Embodiments of the subject invention provide novel and advantageous shingles, as well as methods of fabricating and using the shingles and roofs comprising the shingles. A shingle can include a plurality of perforations in the protruding part thereof to significantly reduce the pressure in the leading edge, the remainder of the protruding part (i.e., the part of the shingle that protrudes beyond the sealing strip), and even in the area behind the sealing strip of the shingle. The perforations can be disposed in the protruding part of the shingle down (i.e., in the direction water flows downward on the roof) from the sealing strip (i.e., between the leading edge and the sealing strip). Thus, any water entering the perforations can be blocked by the sealing strips and can flow down the roof slope. The shingle can be, for example, an asphalt shingle, though embodiments are not limited thereto.

Wind loads on asphalt roofing shingles are dictated by the local element flow field among other parameters such as the building geometry and upstream terrain and flow conditions. Asphalt shingles experience high wind loads due to wind flows that separate from their leading edges to cause suction on the top surface while simultaneously causing positive pressure on the lower surface (see also, e.g., Peterka et al., Wind Uplift Model for Asphalt Shingles, Journal of Architectural Engineering, 1997; which is hereby incorporated by reference herein in its entirety). This local phenomenon results in a loading mechanism that seeks to peel off the shingles by essentially grabbing their protruding section and rolling it over. Once this lift-off is initiated, the load on the shingle significantly increases due to a change in the local aerodynamics. This notion forms the basis for the current standardized tests for the wind resistance of asphalt shingles, e.g., the American Society for Testing and Materials (ASTM) Standard Test Method for Wind Resistance of Asphalt Shingles (Uplift Force/Uplift Resistance Method), designated as D7158/D7158M (ASTM International, 2020b; which is hereby incorporated by reference herein in its entirety).

Figure 1A:
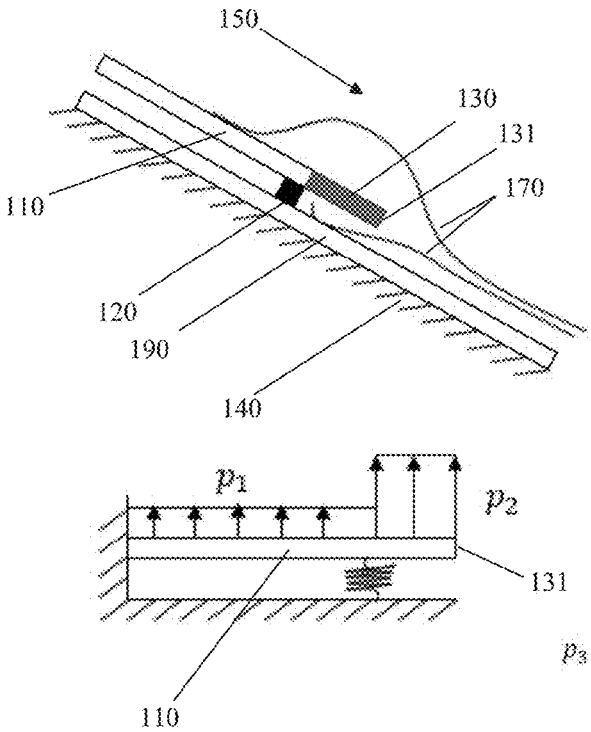
FIG. 1A shows a cross-sectional view of wind against a shingle.
Figure 1B:
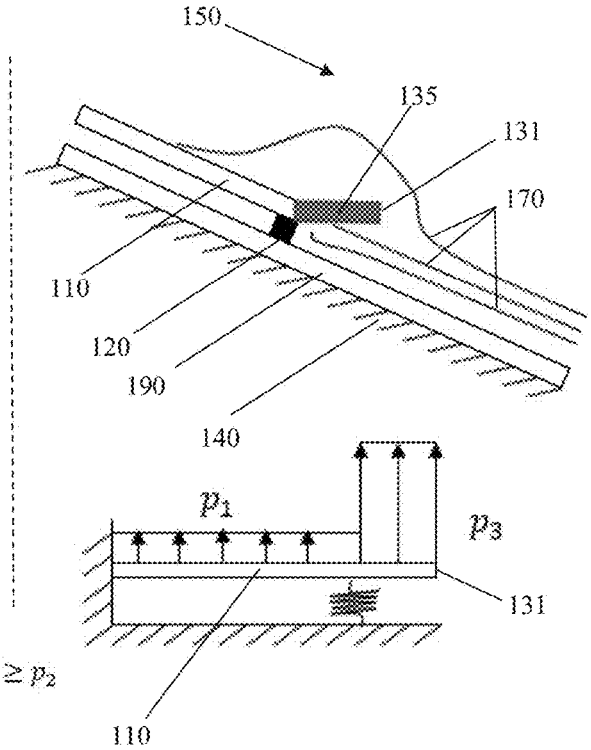
FIG. 1B shows a cross-sectional view of wind against a shingle, with a leading edge starting to lift-off.

This loading mechanism is depicted in FIGS. 1A and 1B, in which direction 150 indicates the slope of the roof (i.e., the direction water would flow downward on the roof towards the ground). Referring to FIG. 1A, the shingle 110 is disposed on the main roof surface 140 and sealed with a sealing strip 120. The shingle 110 can be adhered via the sealing strip 120 to the main roof surface 140 or to another shingle 190 below. The shingle 110, and particularly its leading edge 131 and protruding part 130, is exposed to wind 170. The bottom portion of FIG. 1A shows a diagram of the pressure experienced by the main part of the shingle 110 ($p_1$) and that experienced by the protruding part 130 ($p_2$). Referring to FIG. 1B, the protruding part has experienced lift-off and is now a lifted off protruding part 135 due to the wind 170. The lower part of FIG. 1B shows a diagram of the pressure experienced by the main part of the shingle 110 ($p_1$) and that experienced by the lifted off protruding part 135 ($p_3$). As indicated in FIGS. 1A and 1B, $p_3 \geq p_2$.

Introduction of the perforations or holes in the protruding part of the shingles allows pressure reduction in the cavity, where pressure buildup would otherwise occur due to flow stagnation. Through these small holes on the protruding part of the shingle, flow is directed upward out of the cavities. With these holes in place, the positive pressure inside the cavity would be the same pressure that causes the trapped fluid to exit through the perforations. In addition to the cavity pressure, the flow out of the cavity is enhanced by the venturi effect, due to the small perforations, and suction on the top surface of the shingles, which creates a vacuum in the separation bubble. The high-speed flow through these perforations can also break the separation bubble, thereby reducing the suction on the top surface of the shingle.

FIGS. 3A and 3B show the loading mechanism of a shingle having perforations, according to an embodiment of the subject invention. Referring to FIG. 3A, the shingle 110 is disposed on the main roof surface 140 and sealed with a sealing strip 120. The shingle 110 can be adhered via the sealing strip 120 to the main roof surface 140 or to another shingle 190 below. The shingle 110, and particularly its leading edge 131 and protruding part 130, is exposed to wind 170. The protruding part 130 includes a perforation 137 disposed between the sealing strip 120 and the leading edge 131, and some of the wind 170 goes through the perforation 137, changing the aerodynamics of the shingle 110 compared to the case depicted in FIG. 1A. The bottom portion of FIG. 3A shows a diagram of the pressure experienced by the main part of the shingle 110 ($p_1'$) and that experienced by the protruding part 130 ($p_2'$). Referring to FIG. 3B, the protruding part has experienced lift-off and is now a lifted off protruding part 135 due to the wind 170. Some of the wind 170 is still going through the perforation 137, again changing the aerodynamics of the shingle 110 compared to the case depicted in FIG. 1B. The lower part of FIG. 3B shows a diagram of the pressure experienced by the main part of the shingle 110 ($p_1'$) and that experienced by the lifted off protruding part 135 ($p_3'$). As indicated in FIGS. 3A and 3B, $p_1' \leq p_1$, $p_2' < p_2$, and $p_3' < p_3$. That is, the upward pressure experienced by the protruding part in both states 130,135 is decreased when the perforations 137 are present, and the pressure experienced by the main part of the shingle 110 is either the same or decreased when the perforations 137 are present.

Figure 2B:
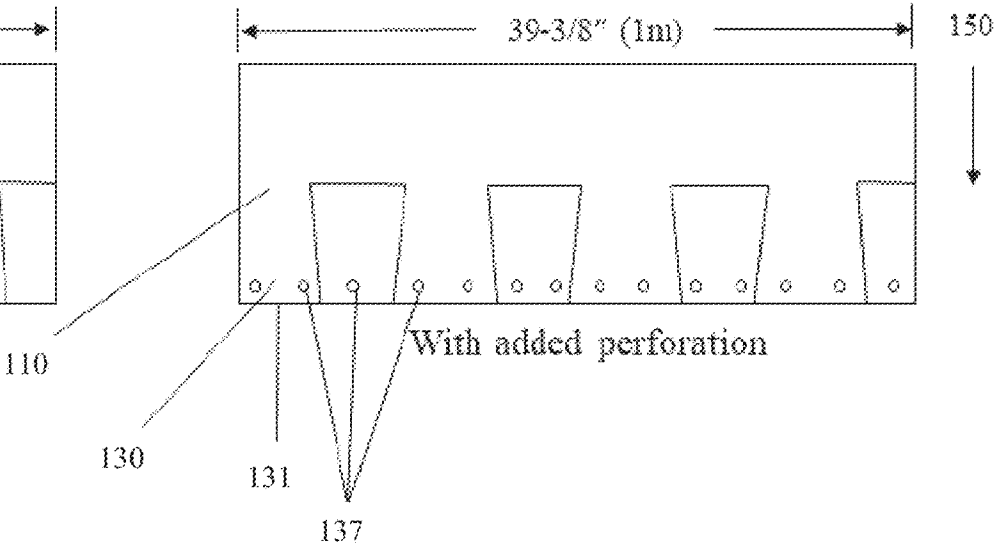
FIG. 2B shows a top view of shingles with perforations on the leading edges thereof, according to an embodiment of the subject invention.
Figure 2A:
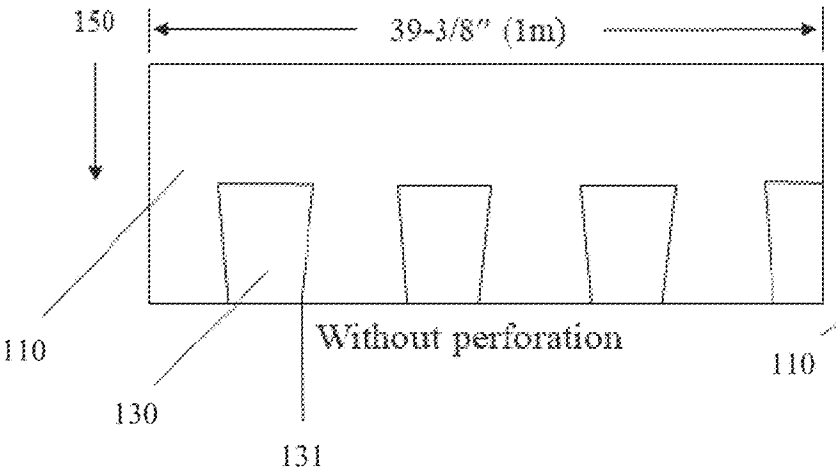
FIG. 2A shows a top view of shingles without perforations.

FIG. 2A shows a top view of shingles without perforations, and FIG. 2B shows a top view of shingles with perforations on the leading edges thereof, according to an embodiment of the subject invention. Though FIGS. 2A and 2B show dimensions, these are for exemplary purposes only and should not be construed as limiting. Referring to FIG. 2B, the shingle 110 can include a plurality of perforations 137 on the protruding part 130 thereof, near the leading edge 131. The perforations 137 can have any cross-sectional shape, such as circles (as depicted in FIG. 2B), squares, triangles, rectangles, or others. Also, in many embodiments, all perforations 137 can have the same cross-sectional shape. In an embodiment, the perforations 137 can all be spaced apart from the leading edge 131 of the shingle(s) 110 by the same distance. In an embodiment, the perforations 137 can be equidistant from each other in a lateral direction (i.e., the perforations 137 can be equally spaced apart from each other in the lateral direction that is perpendicular to the downward slope direction 150 and parallel to the main surface 140 of the roof).

The shingle can have a perforation percentage defined as the percentage of the area of the protruding part of the shingle (the part that extends beyond the sealing strip) that is taken up by the perforation(s) 137. For example, if the protruding part has a width of 12 square inches ($in^2$) and has six perforations each with an area of 0.5 $in^2$, this would result in the perforations taking up 3 $in^2$ of the area of the protruding part, thereby giving a perforation percentage of 25% (3 inches/12 inches). A shingle can have a perforation percentage of any of the following values, about any of the following values, at least any of the following values, at most any of the following values, or within any range having any of the following values as endpoints (all values are in %): 1, 2, 3, 4, 5, 6, 7, 8, 9, 10, 11, 12, 13, 14, 15, 16, 17, 18, 19, 20, 21, 22, 23, 24, 25, 26, 27, 28, 29, or 30. For example, a shingle can have a perforation percentage of about 10% or 10% as shown for exemplary purposes only in FIGS. 7C, 8C, and 12C.

Asphalt shingles represent 80% of the residential roofing market in the United States and have been the most widely used roofing materials for sloped roofs for more than a century. However, efforts are still ongoing to increase their wind resistance as previous wind events have repeatedly shown a deficit in their wind performance. Many post-disaster surveys have reported the failure of these roofing elements during wind events that were below their design levels. Related art systems and methods have been directed to improving their installation techniques and the resistance of both mechanical and bituminous connections to enhance their wind resistance. In contrast, embodiments of the subject invention bring to light an aerodynamic innovation that focuses on improving the aerodynamic design of the shingles, which reduces the wind load experienced by the shingle during a wind event.

The shingle lift-off model by Peterka et al. (supra.) shows that shingles are lifted due to suction over the shingle's leading edge and a positive pressure that develops underneath. A combined mechanism of these two loads increases the net uplift pressure on these shingles. Embodiments of the subject invention relieve the pressure developed underneath the shingles while simultaneously lowering the suction over the top surface. By providing an opening (in the form of perforations), air trapped under the shingle is caused to leave the cavity, which prevents or inhibits the build-up of positive pressure. Besides the pressure in the cavity, a venturi effect due to small size of the perforations and suction on upper surface of the shingle will further drive the flow by increasing the wind speed at which the fluid leaves the cavity. This increase in speed results in a jet of air that breaks the separation bubble over the shingle, thereby reducing the suction over the roof surface.

The transitional term "comprising," "comprises," or "comprise" is inclusive or open-ended and does not exclude additional, unrecited elements or method steps. By contrast, the transitional phrase "consisting of" excludes any element, step, or ingredient not specified in the claim. The phrases "consisting" or "consists essentially of" indicate that the claim encompasses embodiments containing the specified materials or steps and those that do not materially affect the basic and novel characteristic(s) of the claim. Use of the term "comprising" contemplates other embodiments that "consist" or "consisting essentially of" the recited component(s).

When ranges are used herein, such as for dose ranges, combinations and subcombinations of ranges (e.g., subranges within the disclosed range), specific embodiments therein are intended to be explicitly included. When the term "about" is used herein, in conjunction with a numerical value, it is understood that the value can be in a range of 95% of the value to 105% of the value, i.e. the value can be +/−5% of the stated value. For example, "about 1 kg" means from 0.95 kg to 1.05 kg.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to embodiments of the invention.

Materials and Methods

Near-surface flows were simulated using a steady K-epsilon Reynolds-averaged Navier Stokes (RANS) turbulence model. A control whole shingle (i.e., no perforations) and a perforated shingle with a perforation percentage of 10% were used. A uniform inlet velocity of 10 meters per second (m/s) with a turbulence intensity of 5% was used for the wind. The number of mesh cells used for all cases was on the order of 3.55 million.

Example 1

Figure 4:
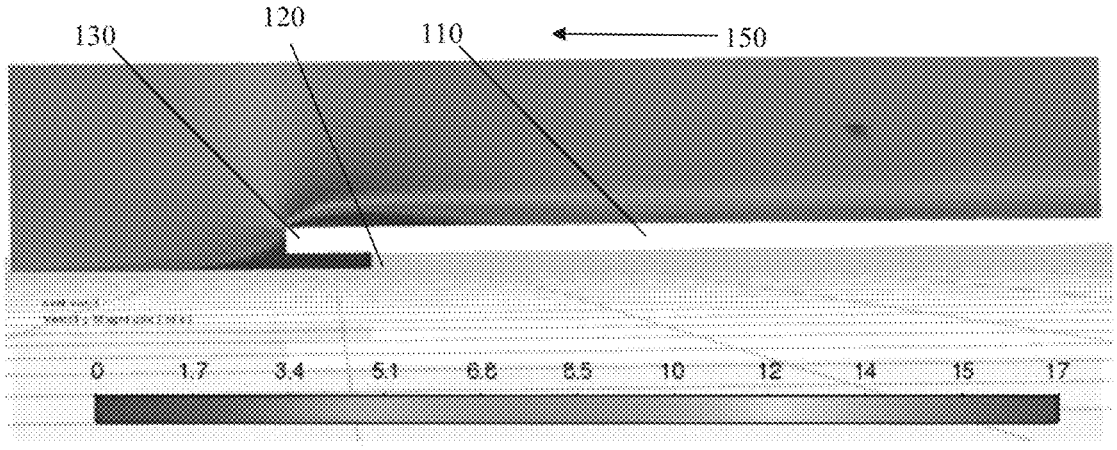
FIG. 4 shows a velocity contour of a cross-section of a shingle that has no perforations, with wind applied against it.
Figure 5:
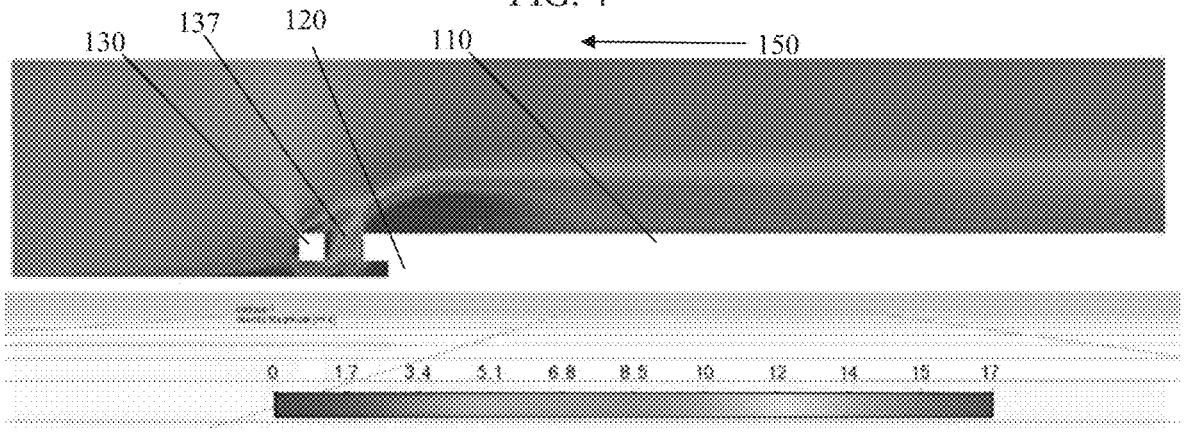
FIG. 5 shows a velocity contour, at the location of a perforation, of a cross-section of a shingle that has perforations, with wind applied against it.
Figure 6:
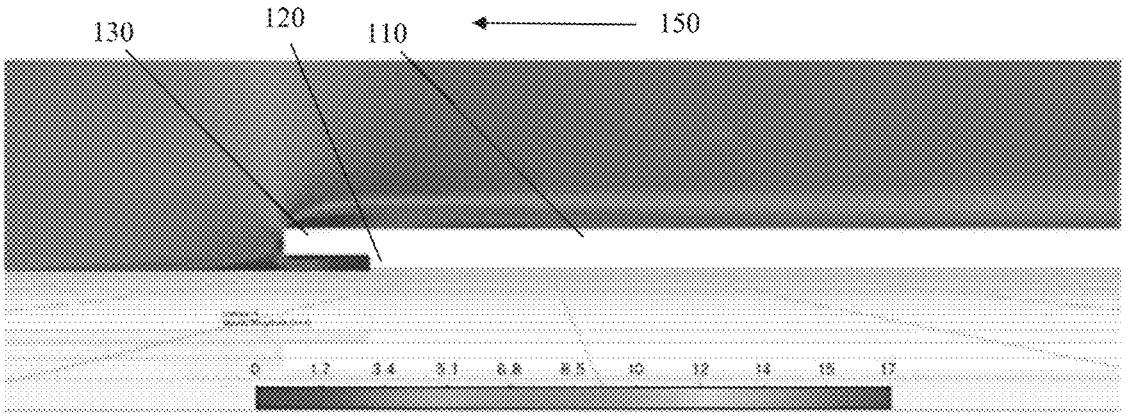
FIG. 6 shows a velocity contour, at a location where no perforation is present, of a cross-section of a shingle that has perforations, with wind applied against it.
Figure 7A:
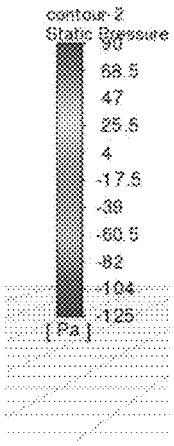
FIG. 7A shows a key for the static pressure contours of FIGS. 7B and 7C. The lowest pressure on the key is −125 Pascals (Pa), and the highest pressure on the key is 90 Pa.
Figure 7B:
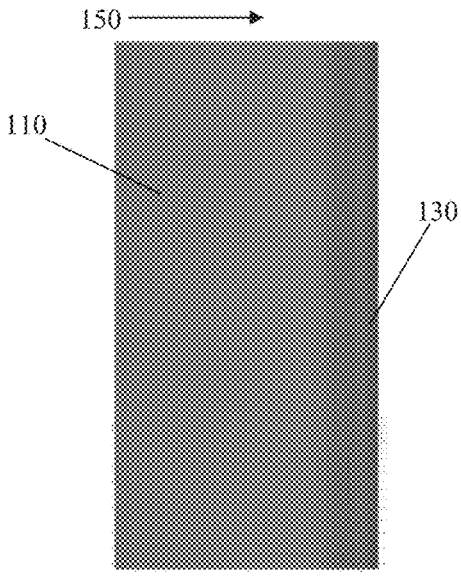
FIG. 7B shows a pressure contour on a top surface of a shingle that has no perforations, with wind applied against it.
Figure 7C:
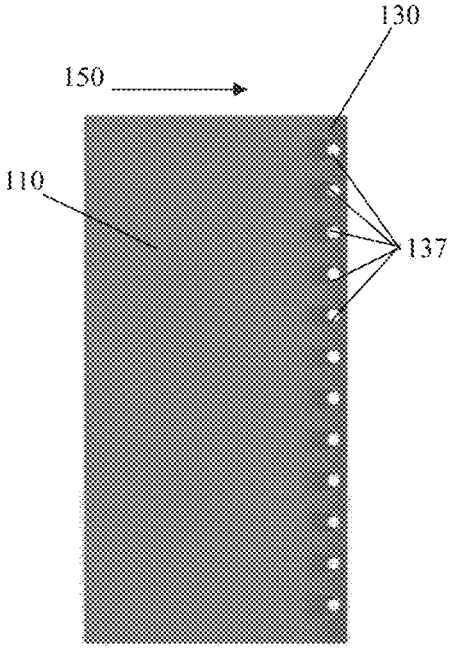
FIG. 7C shows a pressure contour on a top surface of a shingle that has perforations, with wind applied against it.
Figure 8A:
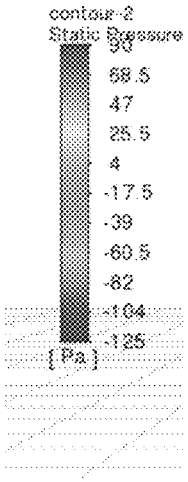
FIG. 8A shows a key for the static pressure contours of FIGS. 8B and 8C. The lowest pressure on the key is −125 Pa, and the highest pressure on the key is 90 Pa.
Figure 8B:
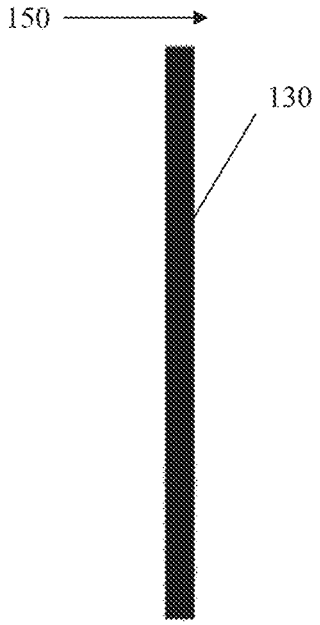
FIG. 8B shows a pressure contour on a bottom surface of a leading edge of a shingle that has no perforations, with wind applied against it.
Figure 8C:
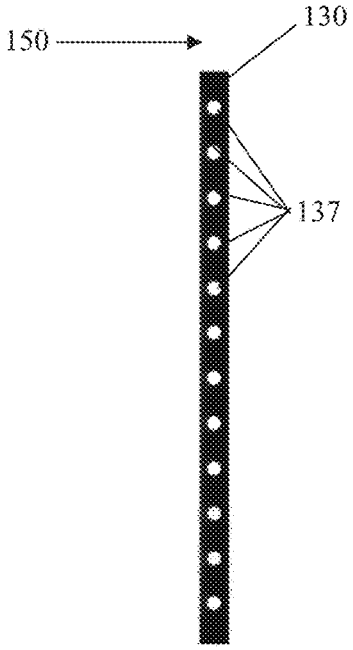
FIG. 8C shows a pressure contour on a bottom surface of a leading edge of a shingle that has perforations, with wind applied against it.

The velocity and pressure contours were simulated for wind applied to the control shingle and the shingle having perforations with a perforation percentage of 10%. FIG. 4 shows a velocity contour of a cross-section of the control shingle; FIG. 5 shows a velocity contour, at the location of a perforation, of a cross-section of the shingle with perforations; FIG. 6 shows a velocity contour, at a location where no perforation is present, of a cross-section of the shingle with perforations; FIG. 7B shows a pressure contour of a top surface of the control shingle; FIG. 7C shows a pressure contour of a top surface of the shingle with perforations; FIG. 8B a pressure contour of a bottom surface of a leading edge of the control shingle; and FIG. 8C shows a pressure contour on a bottom surface of a leading edge of the shingle with perforations.

Referring to FIGS. 4-8C, the results showed that the perforations reduce the pressure on the protruded part of the shingle. The velocity contour plots in FIG. 4 shows that stagnated air below the leading edge of the shingle is present. This stagnated air volume is responsible for the positive pressure developing in this area. Also, flow separations from the leading edge of the shingle did create negative pressure on the top surface of the shingle, as expected (see also FIG. 7B).

When the perforations were included, wind flow underneath the shingle was generated. That is, there is no stagnated flow in this case (see also FIGS. 5 and 6). This not only resulted in reduced underneath positive pressure, but also a destruction of the separation bubble as accelerated flow from the protrusions due to venturi effect meets flow on the top surface of the shingle. This effect was not restricted to cross sections where the perforations were located. As seen in FIG. 6, areas near the perforations were also observed to experience flow underneath the leading edge. This is due to the air flow directed parallel to the leading edge. This resulted in reduced volume of air being trapped underneath the shingles.

The separation bubble being affected by the flow through the added holes significantly reduced the suction on the top shingle surface (see also FIGS. 7B and 7C). In addition to this, positive pressure below the leading edge of the shingle was also reduced (see also FIGS. 8B and 8C). Similarly, the vector sum of pressures at the top and bottom shingle surfaces, which is the net pressure responsible for causing shingle lift-off, was reduced by the addition of the perforations in the protruding part of the shingle.

Example 2

Figure 9:
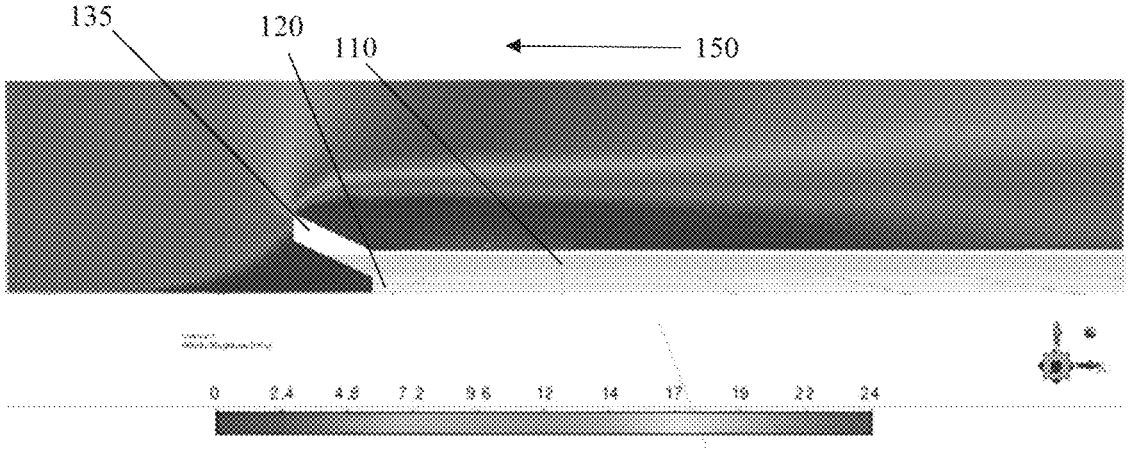
FIG. 9 shows a velocity contour of a cross-section of a shingle that has no perforations, with wind applied against it and with its leading edge lifted off at an angle of 25° with respect to the main roof surface.
Figure 10:
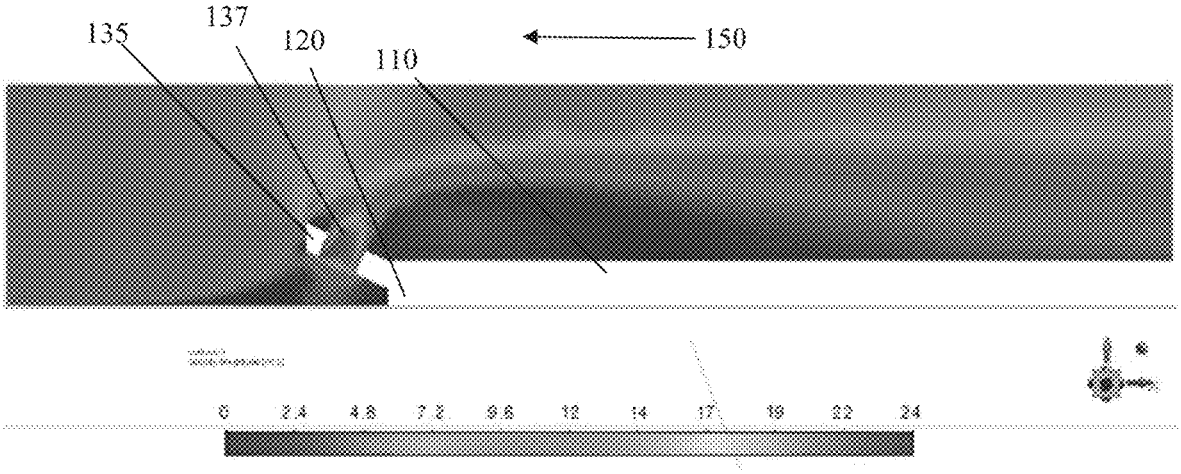
FIG. 10 shows a velocity contour, at the location of a perforation, of a cross-section of a shingle that has perforations, with wind applied against it and with its leading edge lifted off at an angle of 25° with respect to the main roof surface.
Figure 11:
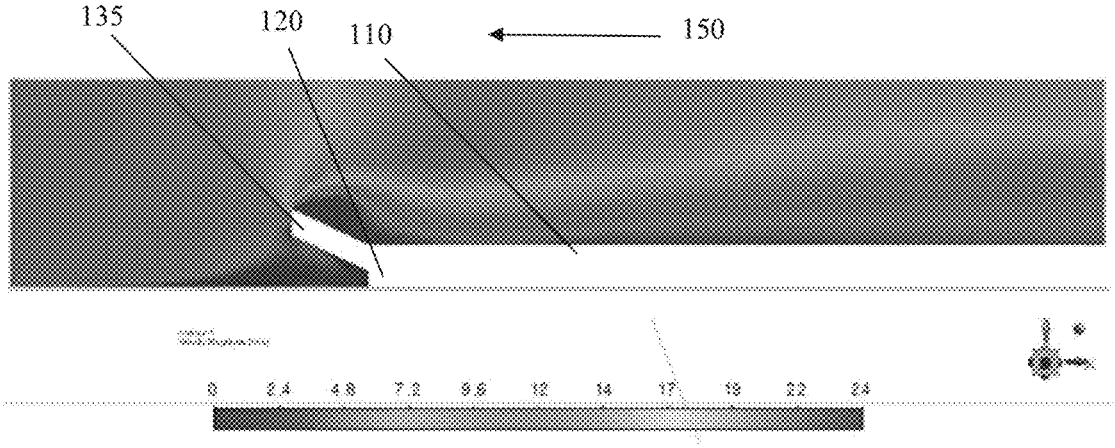
FIG. 11 shows a velocity contour, at a location where no perforation is present, of a cross-section of a shingle that has perforations, with wind applied against it and with its leading edge lifted off at an angle of 25° with respect to the main roof surface.
Figure 12A:
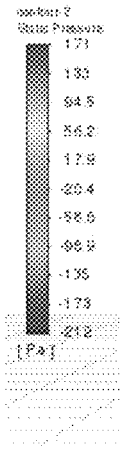
FIG. 12A shows a key for the static pressure contours of FIGS. 12B and 12C. The lowest pressure on the key is −212 Pa, and the highest pressure on the key is 171 Pa.
Figure 12B:
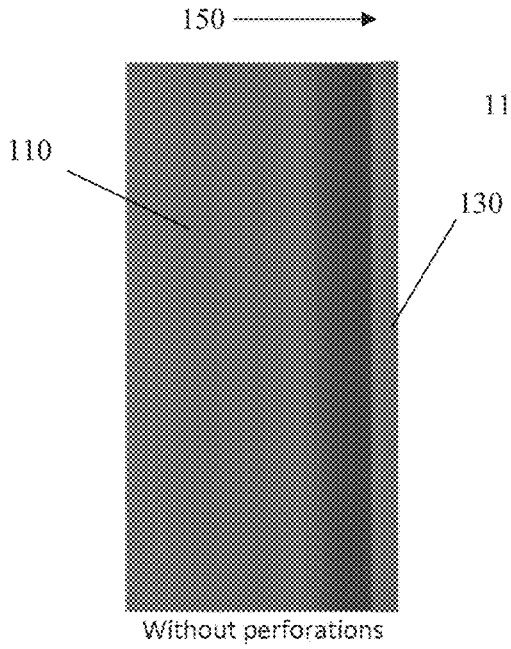
FIG. 12B shows a pressure contour on a top surface of a shingle that has no perforations, with wind applied against it and with its leading edge lifted off at an angle of 25° with respect to the main roof surface.
Figure 12C:
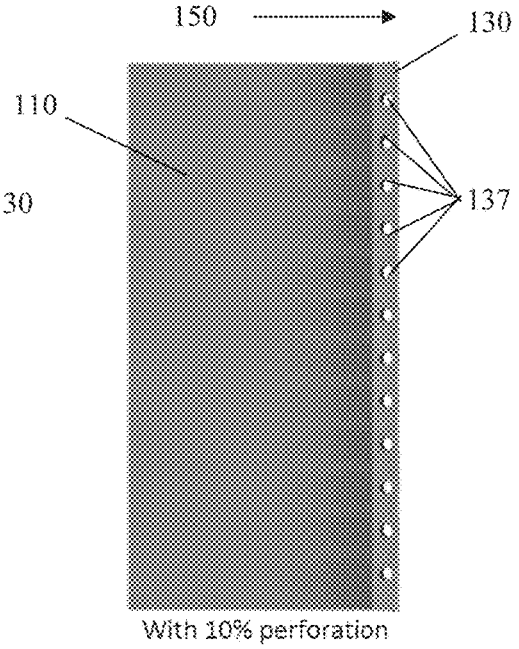
FIG. 12C shows a pressure contour on a top surface of a shingle that has perforations, with wind applied against it and with its leading edge lifted off at an angle of 25° with respect to the main roof surface.

The velocity and pressure contours were simulated for wind applied to the control shingle and the shingle having perforations with a perforation percentage of 10%, but with the leading edge experiencing lift-off to an angle of 25° with respect to the main roof surface. FIG. 9 shows a velocity contour of a cross-section of the control shingle; FIG. 10 shows a velocity contour, at the location of a perforation, of a cross-section of the shingle with perforations; FIG. 11 shows a velocity contour, at a location where no perforation is present, of a cross-section of the shingle with perforations; FIG. 12B shows a pressure contour of a top surface of the control shingle; and FIG. 12C shows a pressure contour of a top surface of the shingle with perforations.

The effect of the perforations is also significant even after the protruding part has started to lift-off. Damage to shingles does not necessarily occur when the leading edge and/or protruding part lifts off, but rather when the adhesion between the top and bottom shingle through the sealing strip is lost. The application of the perforations resulted in reduced pressure compared to the control shingle.

As expected, shingles with their leading edge slightly lifted experience higher wind load due to modification in the aerodynamics. Obstruction to flow leads to increase in wind speed over the shingle surface, which increases the suction on the shingle surface. Similar phenomenon is experienced by shingles with added perforations as their leading edges were slightly lifted. However, this time the flow through the perforations increased in speed, and the increase in positive pressure underneath the leading edge led up to an increase in flux through the perforations. These flows then caused a breakup of the separation bubble, as seen in FIG. 10, that reduced the surface pressure compared to the control shingle (FIG. 9).

The effect of the perforations was not restricted to cross-sections where the holes are located. FIG. 11 shows that there is flow in the areas between the perforations as opposed to the stagnated flow in the case of the control shingle.

In addition, FIGS. 12B and 12C show the difference in pressure between the control shingle and the shingle with added perforations. The control shingle experienced much higher upward pressure in the protruded portion than did the shingle with perforations.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A roof shingle, comprising:

an upper surface and a lower surface opposite from the upper surface;

a sealing strip disposed on the lower surface and configured to adhere the roof shingle to another roof shingle or to a main surface of a roof;

a protruding part protruding away from the sealing strip in a direction parallel to the upper surface of the roof shingle, the protruding part comprising a leading edge connecting the upper surface and the lower surface and configured to face in a downward slope direction of a roof on which the roof shingle is disposed; and a plurality of perforations disposed on the protruding part and penetrating through the roof shingle from the upper surface of the roof shingle to the lower surface of the roof shingle.

2. The roof shingle according to claim 1, the plurality of perforations being disposed between the leading edge and the sealing strip.

3. The roof shingle according to claim 1, each perforation of the plurality of perforations having a circular cross-section, taken in a plane parallel to the lower surface of the roof shingle.

4. The roof shingle according to claim 1, having a perforation percentage of at least 3%, the perforation percentage being an area of an upper surface of the protruding part taken up by the plurality of perforations divided by a total area of the upper surface of the protruding part.

5. The roof shingle according to claim 4, having a perforation percentage of at least 5%.

6. The roof shingle according to claim 4, having a perforation percentage of at least 10%.

7. The roof shingle according to claim 1, having a perforation percentage of about 10%, the perforation percentage being an area of an upper surface of the protruding part taken up by the plurality of perforations divided by a total area of the upper surface of the protruding part.

8. The roof shingle according to claim 1, a shortest distance from each perforation of the plurality of perforations to the leading edge being the same as that for all other perforations of the plurality of perforations.

9. The roof shingle according to claim 1, the plurality of perforations being disposed in an equidistant manner across the roof shingle in a lateral direction perpendicular to the downward slope direction and parallel to the lower surface of the roof shingle.

10. The roof shingle according to claim 1, the roof shingle being an asphalt roof shingle.

11. A roof shingle system, comprising:

a main roof surface; and a plurality of roof shingles disposed on the main roof surface, each roof shingle of the plurality of roof shingles being the roof shingle according to claim 1.

12. The roof shingle system according to claim 11, the plurality of perforations for all roof shingles being disposed in an equidistant manner across the roof shingle system in a lateral direction perpendicular to the downward slope direction and parallel to the lower surface of each roof shingle.

13. A roof shingle system, comprising:

a main roof surface; and a plurality of roof shingles disposed on the main roof surface, each roof shingle of the plurality of roof shingles being the roof shingle according to claim 2.

14. A roof shingle system, comprising:

a main roof surface; and a plurality of roof shingles disposed on the main roof surface, each roof shingle of the plurality of roof shingles being the roof shingle according to claim 3.

15. A roof shingle system, comprising:

a main roof surface; and a plurality of roof shingles disposed on the main roof surface, each roof shingle of the plurality of roof shingles being the roof shingle according to claim 5.

16. A roof shingle system, comprising:

a main roof surface; and a plurality of roof shingles disposed on the main roof surface, each roof shingle of the plurality of roof shingles being the roof shingle according to claim 6.

17. A roof shingle system, comprising:

a main roof surface; and a plurality of roof shingles disposed on the main roof surface, each roof shingle of the plurality of roof shingles being the roof shingle according to claim 8.

18. A roof shingle system, comprising:

a main roof surface; and a plurality of roof shingles disposed on the main roof surface, each roof shingle of the plurality of roof shingles being the roof shingle according to claim 10.

19. A roof shingle, comprising:

an upper surface and a lower surface opposite from the upper surface;

a sealing strip disposed on the lower surface and configured to adhere the roof shingle to another roof shingle or to a main surface of a roof;

a protruding part protruding away from the sealing strip in a direction parallel to the upper surface of the roof shingle, the protruding part comprising a leading edge connecting the upper surface and the lower surface and configured to face in a downward slope direction of a roof on which the roof shingle is disposed; and a plurality of perforations disposed on the protruding part and penetrating through the roof shingle from the upper surface of the roof shingle to the lower surface of the roof shingle, the plurality of perforations being disposed between the leading edge and the sealing strip, each perforation of the plurality of perforations having a circular cross-section, taken in a plane parallel to the lower surface of the roof shingle, the roof shingle having a perforation percentage of at least 5%, the perforation percentage being an area of an upper surface of the protruding part taken up by the plurality of perforations divided by a total area of the upper surface of the protruding part, a shortest distance from each perforation of the plurality of perforations to the leading edge being the same as that for all other perforations of the plurality of perforations, the plurality of perforations being disposed in an equidistant manner across the roof shingle in a lateral direction perpendicular to the downward slope direction and parallel to the lower surface of the roof shingle, and the roof shingle being an asphalt roof shingle.

20. A roof shingle system, comprising:

a main roof surface; and a plurality of roof shingles disposed on the main roof surface, each roof shingle of the plurality of roof shingles being the roof shingle according to claim 19.

* * * * *